US005419246A

United States Patent [19]

Bibby

[11] Patent Number: 5,419,246

[45] Date of Patent: May 30, 1995

[54] METHOD AND APPARATUS FOR LAYING A GRANULAR PATTERN

[76] Inventor: Kenneth Bibby, 9 Horseshoe Dr., Plainville, Mass. 02762-1610

[21] Appl. No.: 284,888

[22] Filed: Aug. 2, 1994

[51] Int. Cl.[6] ..... B41M 1/10

[52] U.S. Cl. ..... 101/170; 101/150; 101/122

[58] Field of Search ..... 101/122, 129, 142, 150, 101/153, 170, 489, 491, 492; 118/46, 50, 406, 621, 624; 427/197; 355/301, 302

[56] References Cited

U.S. PATENT DOCUMENTS

| | | | |
|---|---|---|---|
| 3,245,341 | 4/1966 | Childress et al. | 101/122 |
| 3,285,168 | 11/1966 | Childress | 101/122 |
| 3,566,786 | 3/1971 | Kanfer | 101/150 |
| 4,157,652 | 6/1979 | Mathes et al. | 118/406 |
| 4,539,908 | 9/1985 | Spengler | 101/153 |
| 4,697,514 | 10/1987 | George et al. | 101/170 |
| 4,800,102 | 1/1989 | Takada | 427/197 |
| 5,065,675 | 11/1991 | Tapper | 101/153 |
| 5,213,042 | 5/1993 | Larios | 101/142 |

*Primary Examiner*—Edgar S. Burr
*Assistant Examiner*—Ren Yan
*Attorney, Agent, or Firm*—Fish & Richardson

[57] ABSTRACT

A method for laying down a continuous, predetermined pattern of granular material upon a moving substrate includes moving the substrate past at least two stations, each station including a rotating drum with a drum wall defining a limited retention region under vacuum, and a plurality of through-apertures arranged in an element of the desired pattern. Granular material applied to the surface of the drum is held by vacuum in the desired pattern. After removal of excess granular material, the vacuum is discontinued causing the granular material to disengage from the drum surface and pass, by force of gravity, onto the surface of the substrate in the form of the predetermined element of the desired predetermined pattern. An apparatus for laying down a continuous, predetermined pattern of granular material upon a moving substrate is also described.

16 Claims, 5 Drawing Sheets

METHOD AND APPARATUS FOR LAYING A GRANULAR PATTERN

BACKGROUND OF THE INVENTION

The invention relates to forming a predetermined pattern of granules on a substrate.

It has been known to place granules of different colors upon a substrate, e.g. where the granules are particles of colored polyvinyl chloride (PVC) plastic and the substrate is a base for flooring tile or sheet, where the substrate is advanced step-wise through a series of stations where granules are placed onto the base through a set of flat stencils. The base is stopped at each station while the colored granules are placed, which restricts the process to use with patterns having straight "grout" lines placed perpendicular to the direction of movement to conceal stop marks formed by the step-wise advance.

SUMMARY OF THE INVENTION

According to one aspect of the invention, an apparatus for laying down a continuous, predetermined pattern of granular material upon a moving substrate comprises a main conveyor mounted for continuous movement of a substrate therealong, and at least a first and second stations disposed along the conveyor, the second station at a position spaced from the first station. Each station comprises a drum with a generally cylindrical drum wall mounted for rotation above the substrate, the drum wall defining drum outer and inner surfaces, a motor for rotating the drum outer surface through a sequence of positions comprising: a granular-material-receiving position, an excess granular-material-separation position, an granular-material-pattern-laydown position, and a cleaning position; a volume defined by the drum wall and a baffle contained therewithin with free ends disposed in sliding engagement with the drum inner surface to define a retention region of the volume corresponding generally to a segment of the drum outer surface between the granular-material-receiving position and the granular-material-pattern-laydown position, the retention region disposed in communication with a source of vacuum, a plurality of apertures defined by the drum wall and in communication between the drum inner and outer surfaces, the plurality of apertures arranged in an element of the predetermined pattern to be formed upon the substrate, a hopper positioned to receive a supply of granular material and to deliver the granular material onto the drum outer surface at the granular-material-receiving position, pre-laydown retriever means, disposed generally between the excess-granular-material-separation position of the drum outer surface and the substrate, for receiving excess granular material from the drum outer surface, a cleaning member disposed at the cleaning position for removing granular particles from the drum surface, and post-laydown retriever means, disposed generally between the substrate and the cleaning position of the drum outer surface, for receiving granular material from the drum outer surface.

Preferred embodiments of the invention may include one or more of the following additional features. The hopper comprises a dam disposed in resilient engagement upon the drum outer surface. The pre-laydown retriever means, preferably comprising a conveyor disposed to move generally transversely to the direction of the main conveyor, is disposed generally below the excess granular-material-separation position of the drum outer surface and above the substrate, for receiving excess granular material from the drum outer surface. The post-laydown retriever means, also preferably a conveyor disposed to move generally transversely to the direction of the main conveyor, is disposed generally below the cleaning position of the drum outer surface and above the substrate, for receiving granular material from the drum outer surface. The cleaning element comprises a brush, e.g. fixed or mounted for rotation, in engagement with the drum outer surface.

According to another aspect of the invention, a method for laying down a continuous, predetermined pattern of granular material upon a substrate comprises the steps of: disposing a substrate upon a main conveyor and moving the conveyor with the substrate thereupon past a series of at least two stations spaced along the conveyor, each station comprising a drum having a generally cylindrical drum wall defining a drum outer surface and a drum inner surface, a volume defined by the drum wall, a plurality of apertures defined by the drum wall and in communication between the drum inner surface and the drum outer surface, the plurality of apertures arranged in an element of the predetermined pattern to be formed upon the substrate, and a hopper for receiving a supply of granular material; rotating the drum wall above the substrate on the continuously moving conveyor through a sequence of positions comprising: a granular-material-receiving position, an excess granular-material-separation position, an granular-material-pattern-laydown position, and a cleaning position; positioning the free ends of a set of baffles disposed within the volume defined by the drum wall in sliding engagement with the drum inner surface to define a retention region of the volume corresponding generally to a segment of the drum outer surface between the granular-material-receiving position and the granular-material- pattern-laydown position; connecting the retention region to a source of vacuum; delivering granular material supplied to the hopper onto the drum outer surface at the granular-material-receiving position; allowing vacuum from the retention region within the volume of the drum to act, through the plurality of apertures arranged in an element of the predetermined pattern to be formed upon the substrate, on granular material upon the drum outer surface in the vicinity of the plurality of apertures, thereby to retain granular material upon the drum outer surface; rotating the drum outer surface to the granular-material-separation position and allowing excess granular material, not subject to action by the vacuum from within the retention region, to separate from the drum outer surface; retrieving separated granular material on pre-laydown retriever means disposed generally between the excess granular-material-separation position of the drum outer surface and the substrate; rotating the drum outer surface to the granular-material-pattern-laydown position at the termination of the retention region under vacuum, and positioning the granular material upon the substrate in the element of the desired predetermined pattern by allowing the granular material to disengage from the drum outer surface by removal of the vacuum; continuing rotation of the drum outer surface to a cleaning station and engaging the drum outer surface with a cleaning member to dislodge remaining granular material from the drum outer surface; retrieving granular material separated by cleaning on post-laydown retriever means disposed generally between the substrate and the cleaning position of the drum outer surface; continuing rotation of the drum outer surface through a series of cycles to laydown a continuous pattern of granular material upon the substrate; and advancing the substrate through a series of stations to lay additional elements of the predetermined pattern of granular material upon the substrate.

Preferred embodiments of the invention may include one or more of the following additional features. The method comprises the further step of treating the substrate to secure the position of the granular material laid upon the substrate. For forming floor covering, the method of comprises the further steps of disposing a pattern of granular material of suitable plastic upon the substrate and securing the granular material by curing. Preferably, the method comprises the further step of disposing a pattern of contrasting granular material, e.g. metallic flake, upon the substrate. For forming wall covering, the method comprises the further steps of disposing a pattern of granular material of suitable plastic upon the substrate and securing the granular material by curing. For forming food products, the method comprises the further steps of disposing a pattern of granular decorative material of suitable edible material upon a food substrate. The method comprises the further step of severing the substrate into a plurality of discrete elements.

Objectives of the invention include to provide a method and apparatus for laying down sequentially a series of pattern elements of granular material upon a continuously moving substrate to form a predetermined pattern. Products suitable for this process include floor and wall coverings, decorated food products, roof tiles and rolls, and concrete pavers and blocks.

Other features and advantages of the invention will be seen from the following description of a presently preferred embodiment, and from the claims.

BRIEF DESCRIPTION OF THE DRAWING

FIG. 13 is a similar view of an apparatus of the invention with a wall covering fabric formed according to another aspect of the invention, while

DESCRIPTION OF THE PREFERRED EMBODIMENTS

Figure 1:
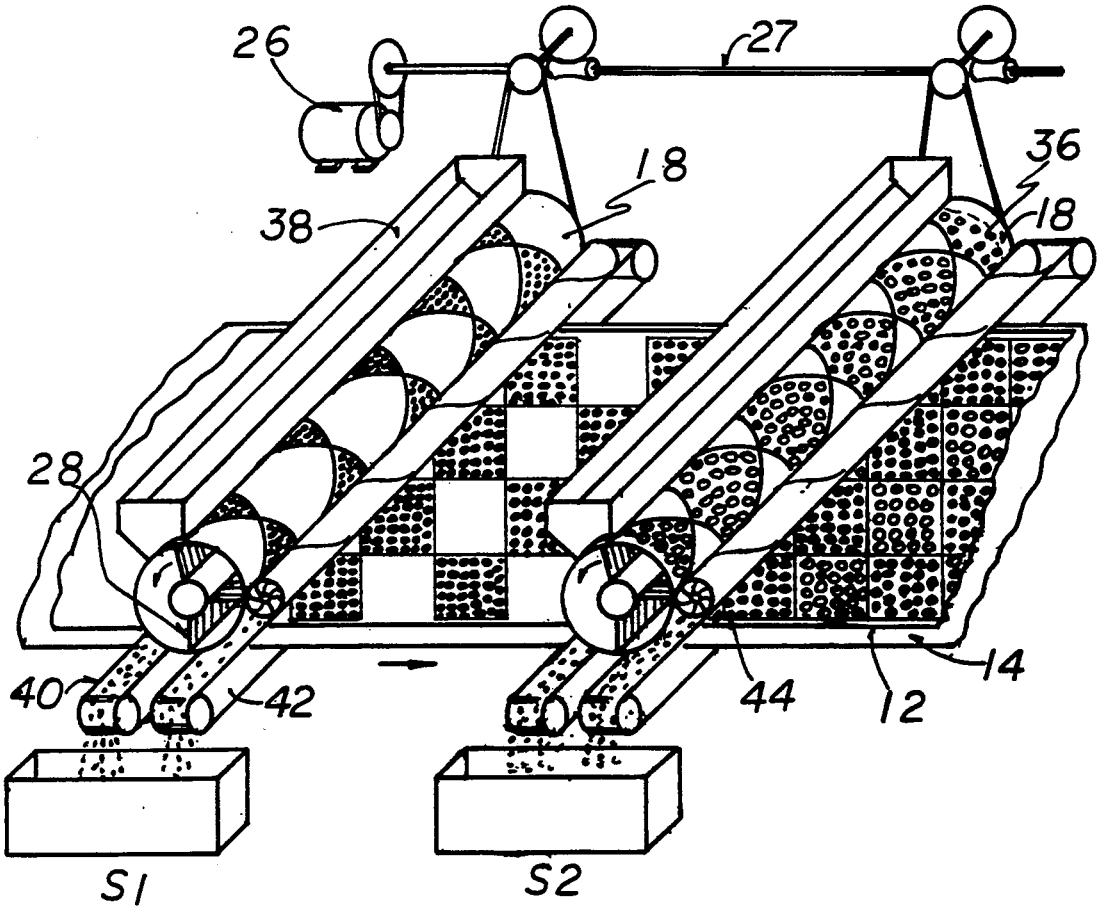
FIG. 1 is a perspective view of an apparatus of the invention.
Figure 2:
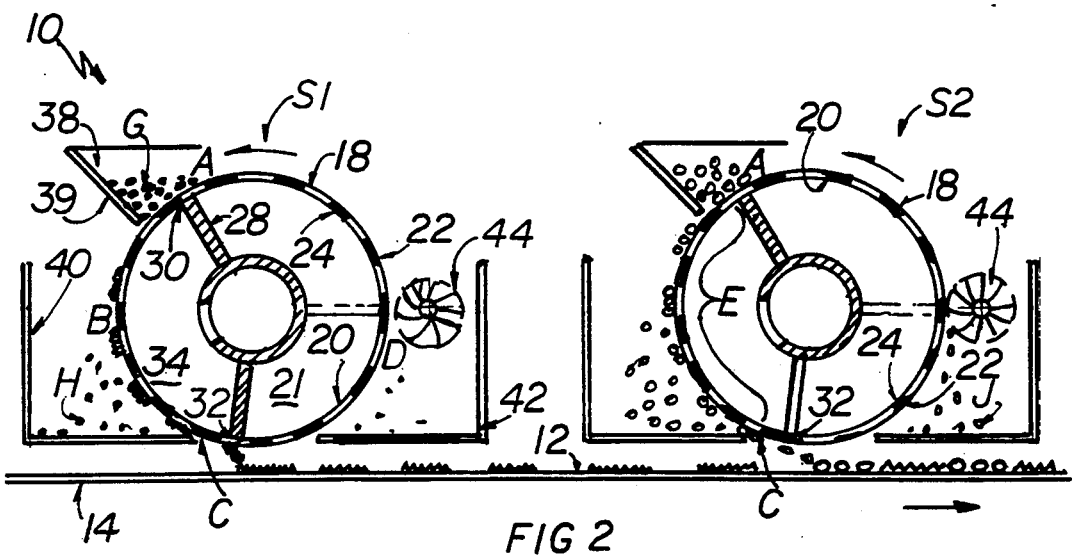
FIG. 2 is a side sectional view of the apparatus of FIG. 1.
Figure 3:
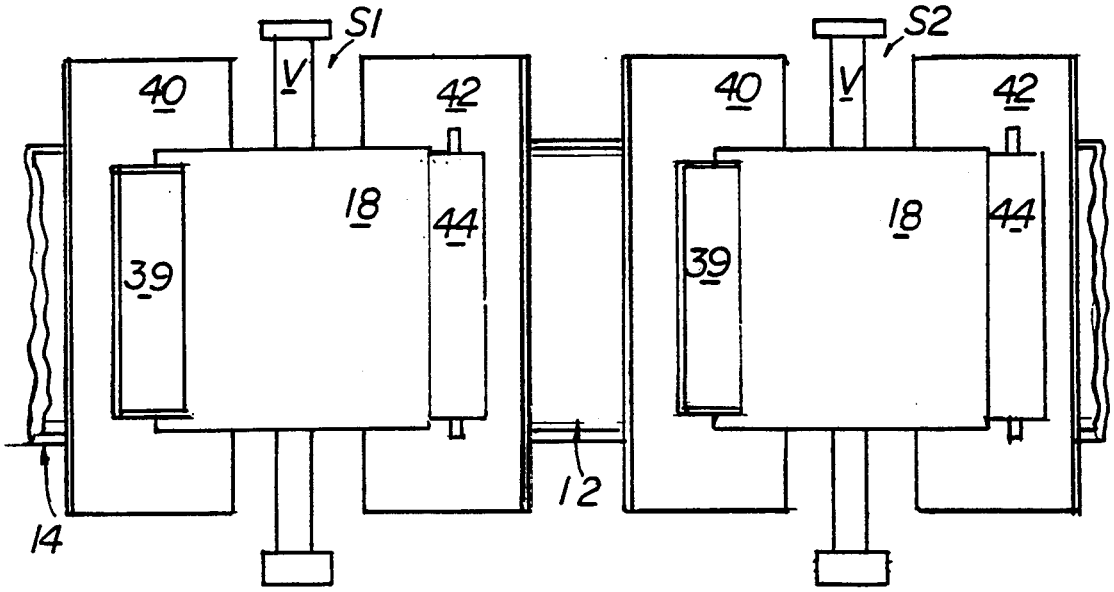
FIG. 3 is a top plan view of the apparatus of FIG.

Referring to FIGS. 1–3, an apparatus 10 of the invention for laying down a continuous, predetermined pattern of granular material upon a moving substrate 12 includes a main conveyor 14 mounted for continuous movement of the substrate therealong and at least two stations, $S_1$, $S_2$, disposed at spaced position along the conveyor.

Each station, S, includes a drum 18 having a generally cylindrical drum wall 20 defining a drum outer surface 22 and a drum inner surface 24. The drum wall 20 is mounted for rotation above the substrate 12 by motor 26, through a sequence of positions, including: granular-material-receiving position (A), excess granular-material-separation position (B), granular-material-pattern-laydown position (C), and a cleaning position (D). In the embodiment shown, the drum outer surface 22 and the surface of the substrate 12 move in the same direction at the granular-material-pattern-laydown position (C); however, the opposed surface may also move in opposite directions.

The drum wall 20 defines a volume 21 with a baffle 28 contained therewithin and having free ends 30, 32 disposed in sliding engagement with the drum inner surface 24, thereby to define a retention region 34 of the volume 21. The retention region 34 is disposed in communication with an external source of vacuum (V) and corresponds generally to a segment (E) of the drum outer surface 22 between the granular-material-receiving position (A) and the granular-material-pattern-laydown position (C).

Figure 4:
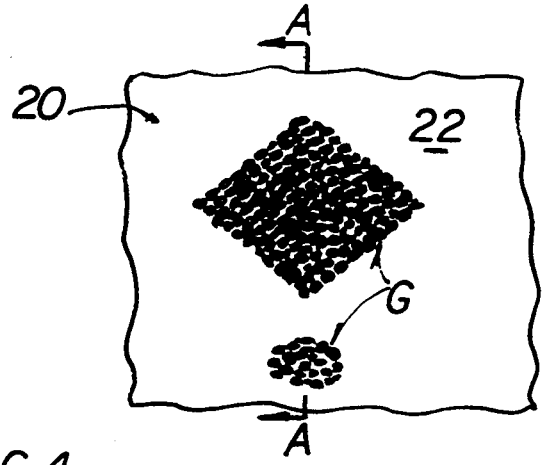
FIGS. 4 and 5 are front plan and side section views respectively of a segment of the drum wall in the region between positions B and C.
Figure 5:
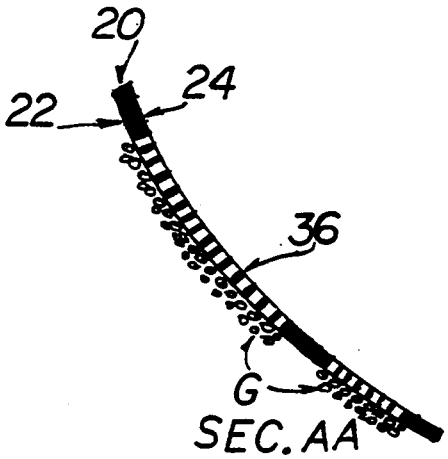

The drum wall 20 defines a plurality of apertures 36 disposed in communication between the drum inner surface 24 and the drum outer surface 22, the plurality of apertures being arranged in an element of the predetermined pattern to be formed upon the substrate (FIGS. 4 and 5). The size and density of the apertures are determined by the size and nature of the granular material. In preferred embodiments, the drum wall has the form of a screen defining densely packed, small diameter holes.

A hopper 38, e.g. a dam 39, mounted at the granular-material-receiving position (A) in resilient engagement with the drum outer surface 22, holds a supply of granular material (G) for delivery onto the substrate, as described below.

A first cross-conveyor 40 is located generally below the excess granular-material-separation position (B), beneath the downward-moving surface of the drum 18, at a position to retrieve excess granular material separated from the drum outer surface 22 before it reaches the surface of the substrate. A similar second cross-conveyor 42 is located generally below the cleaning position (D), beneath the upward-moving surface of the drum 18, at a position to retrieve granular material dislodged from the drum outer surface 22 by a rotating cleaning brush 44.

The method of the invention for laying down a continuous, predetermined pattern of granular material upon a substrate includes disposing a substrate 12 upon a main conveyor 14 and moving the conveyor with the substrate thereupon past a series of at least two stations 16 as described above.

According to the method, granular material (G) supplied to a hopper 38 is delivered onto the drum outer surface 22 at the granular-material-receiving position (A) by allowing the granular material from the hopper to pass beneath the resiliently mounted dam 39.

Vacuum from the retention region 34 within the volume 21 of the drum 20 acts, through the plurality of apertures 36, on granular material (G) upon the drum outer surface 22. The action of the vacuum is localized to the vicinity of the apertures, thereby to retain granular material upon the drum outer surface arranged in an element of the predetermined pattern to be formed upon the substrate.

Rotation of the drum outer surface 22 to the granular-material-separation position (B) allows excess granular material (H), i.e. the granular material not subject to action by the vacuum from within the retention region 34, to separate from the drum outer surface. The excess granular material (H) falls upon the cross-conveyor 40 (before it can reach the surface of the substrate) and is retrieved, e.g. for recycling.

Referring to FIGS. 4 and 5, a segment of the drum wall 20 in the region between positions B and C, i.e., after excess granular material has been removed, leaving only granular material, G, retained on the drum outer surface 22 by the vacuum of the retention region 34 acting through the apertures 36 in the predetermined pattern, e.g. a square is shown by way of example only, as the choice of patterns is essentially unlimited.

Figure 8:
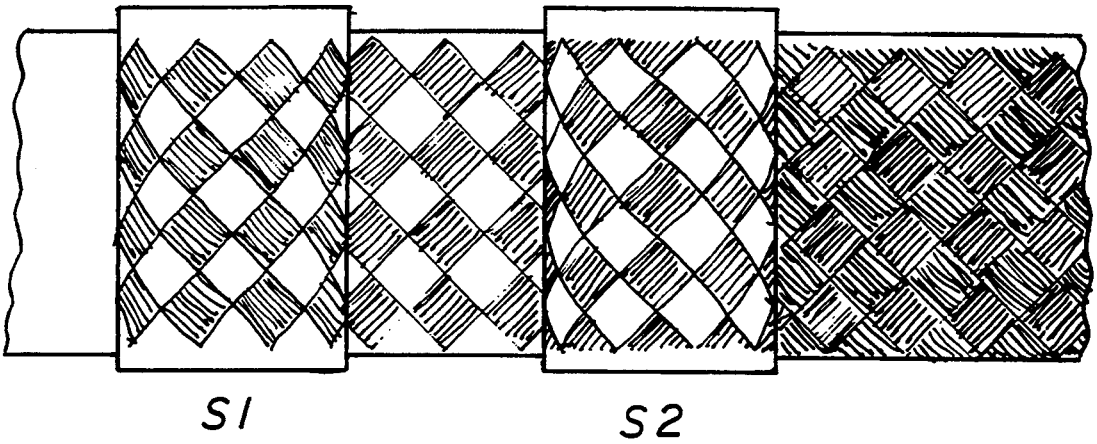
FIGS. 8 and 9 are top plan and side section views, respectively, of a floor covering formed according to the method of the invention.
Figure 9:
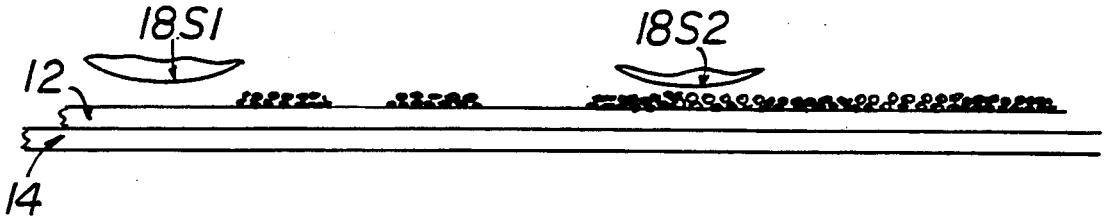
Figure 6:
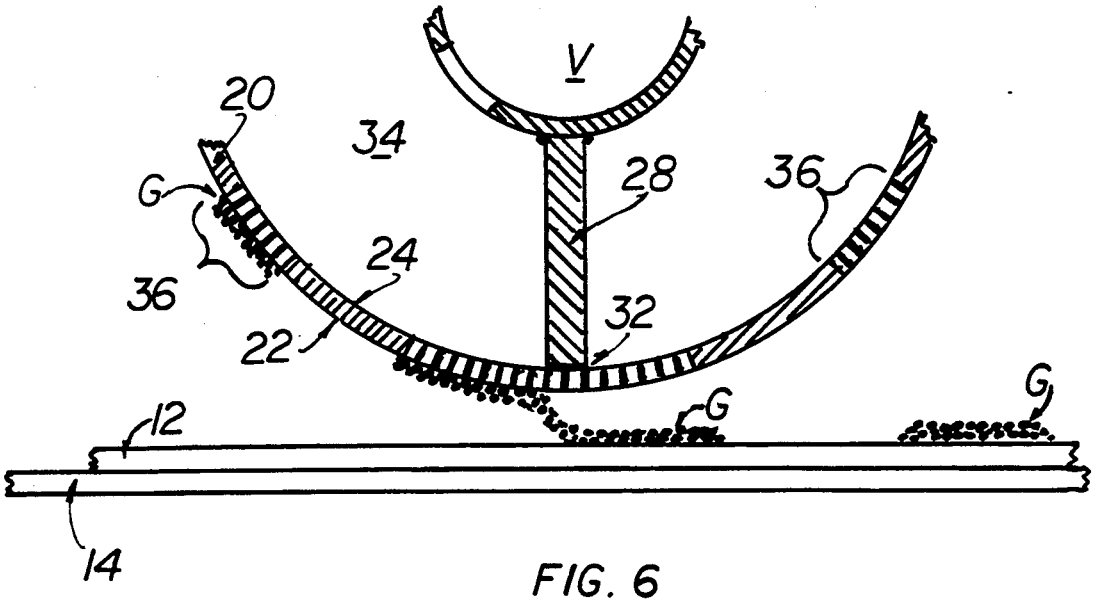
FIG. 6 is a side section view of the segment of the drum wall at the lay-down position C of a first station.
Figure 7:
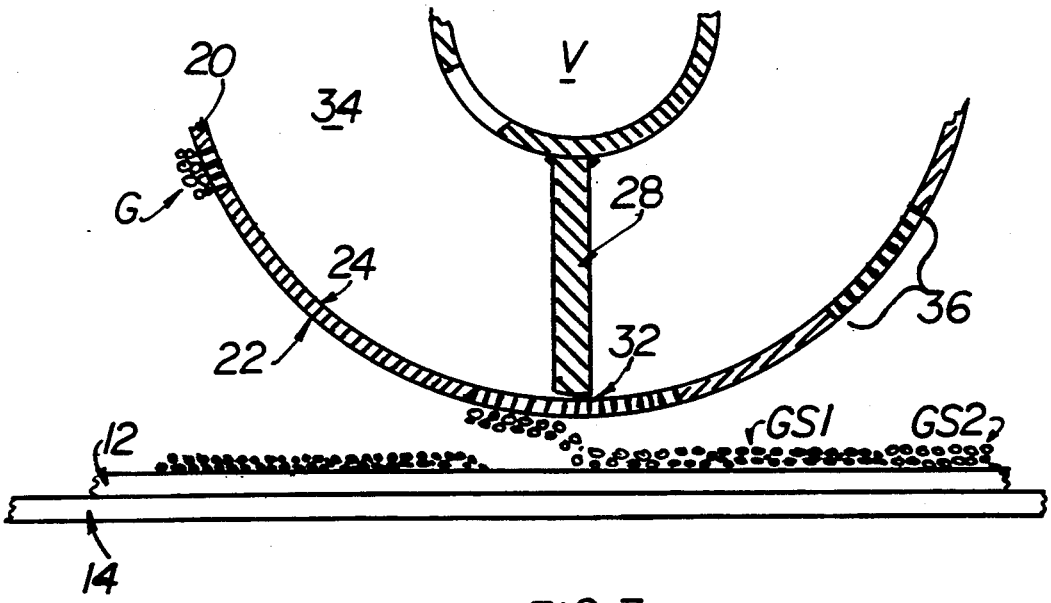
FIG. 7 is a similar view of the drum wall at the lay-down position C of a subsequent station.

Referring now to FIGS. 6 and 7, further rotation of the drum moves the outer surface 22 to the granular-material-pattern-laydown position (C), where the retention region 34 under vacuum terminates in the area of engagement of the baffle free end 32 with the drum inner surface 24. Loss of vacuum as the drum outer surface passes the baffle free end causes the granular material to disengage from the drum outer surface and pass, by force of gravity, onto the surface of the substrate in the form of the predetermined element of the desired predetermined pattern. In FIG. 6, the drum wall 20 delivers the granular material in a first element of the predetermined pattern, and in FIG. 7, the drum wall 20' delivers granular material in a second, different, i.e. intervening, element of the predetermined pattern. Sequential development of the final pattern is shown also in FIGS. 8 and 9, where, in the side view, it is seen that the granular material of the second element complements the angle of repose of the granular material of the first element to define an sharp line of demarcation in the finished pattern. It will be recognized that it is important that precise registration is maintained between separate elements of the pre-determined pattern, which typically requires use of a line shaft 27 with the single motor 26 for rotation of all of the drums 18 in unison, and requires also that each drum be mounted for axial and transverse adjustment relative to movement of the substrate.

Continuing rotation of the drum outer surface 22 to the cleaning station (D) where the drum surface is engaged with a cleaning member, e.g. a rotating brush 44, which dislodges any remaining granular material (J) from the drum outer surface 22. The dislodged granular material (J) separated by cleaning on post-laydown retriever means disposed generally between the substrate and the cleaning position of the drum outer surface, and falls upon the cross-conveyor 42 (again, before it can reach the surface of the substrate) and is retrieved, e.g. for recycling.

The substrate 12 is advanced continuously through a series of stations where additional elements of the predetermined pattern of granular material are applied sequentially upon the substrate.

After the laydown of the entire predetermined pattern is completed, the substrate may be advanced, e.g. to an oven, for curing of the granular material(s) to form an integral layer upon the substrate.

Other embodiments are within the following claims. For example, particles of different material, e.g. powdered material or metallic flake, may be applied to the substrate at one or more stations. The cleaning brush may be mounted for rotation or fixed.

Figure 10:
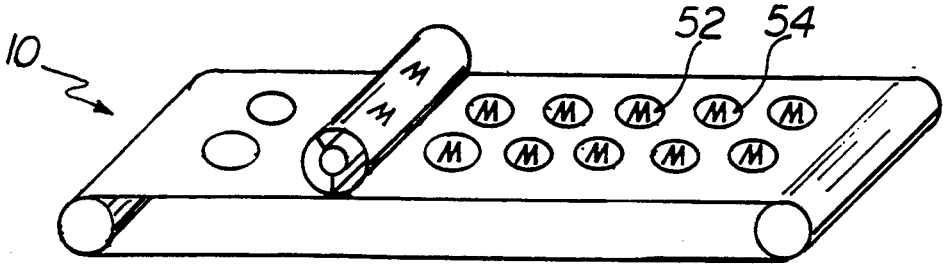
FIG. 10 is a perspective view of an apparatus of the invention with food product formed according to another aspect of the invention.

Also, referring to FIG. 10, an apparatus 50 of the invention may be employed to apply decorative patterns 52 of, e.g., colored granulated sugar or chocolate upon the surface of a moving substrate of food products 54.

Figure 11:
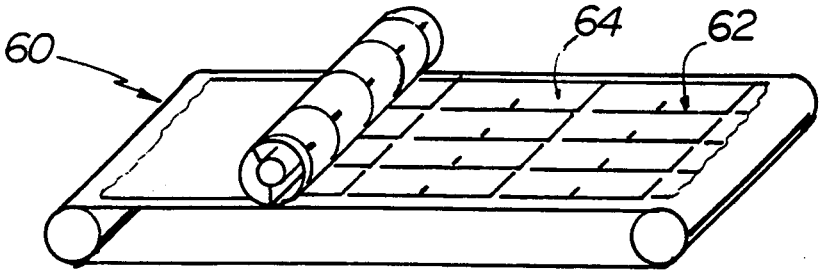
FIG. 11 is a similar view of an apparatus of the invention with roofing shingles formed according to yet another aspect of the invention.
Figure 12:
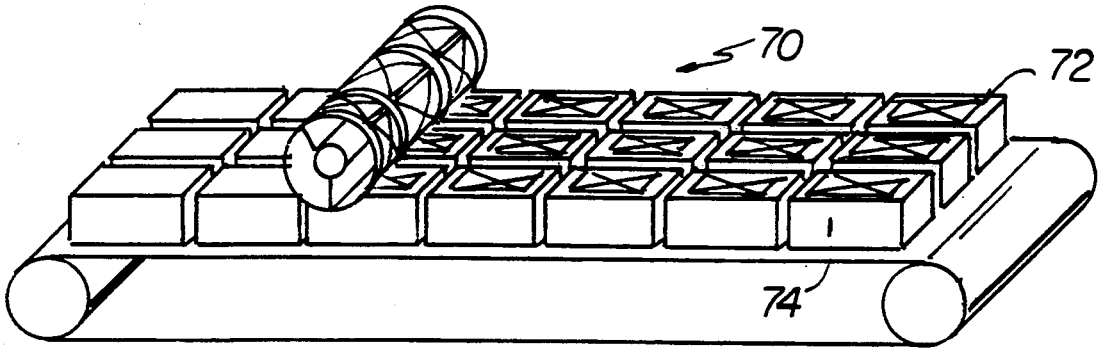
FIG. 12 is a similar view of an apparatus of the invention with paving blocks formed according to the invention.

An apparatus 60 of the invention may be employed to apply a pattern of colored particles, e.g. shadow lines 62, upon rolled roofing material and/or on roofing shingle roll-stock prior to die cutting (64, FIG. 11). An apparatus 70 of the invention may also be employed to apply a granite facing on concrete pavers or shadow lines 72 on concrete blocks 74 moving on a conveyor (FIG. 12).

Figure 13:
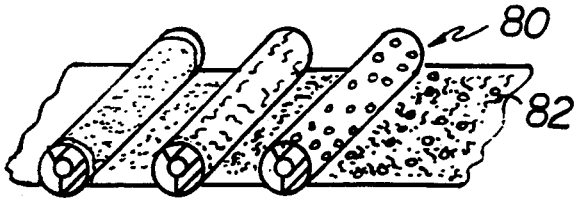
Figure 14:
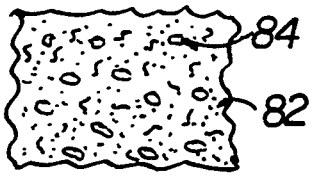
FIG. 14 is a plan view of the wall covering fabric of FIG. 13.

Referring to FIGS. 13 and 14, an apparatus 80 of the invention may also be employed to form a wall covering fabric 82 having solid raised areas 84 of plastic, e.g. of polyvinyl chloride or other suitable plastic material, to replace use of plastic foam, known to increase risks in a fire.

What is claimed is:

1. A method for laying down a continuous, predetermined pattern of granular material upon a substrate, said method comprising the steps of:

disposing a substrate upon a main conveyor and moving the conveyor with the substrate thereupon past a series of at least two stations spaced along the conveyor, each said station comprising a drum having a generally cylindrical drum wall defining a drum outer surface and a drum inner surface, a volume defined by the drum wall, a plurality of apertures defined by the drum wall and in communication between the drum inner surface and the drum outer surface, the plurality of apertures arranged in an element of the predetermined pattern to be formed upon the substrate, and a hopper for receiving a supply of granular material;

rotating the drum wall above the substrate on the continuously moving conveyor through a sequence of positions comprising: a granular-material-receiving position, an excess granular-material-separation position, an granular-material-pattern-laydown position, and a cleaning position;

positioning the free ends of a set of baffles disposed within the volume defined by the drum wall in sliding engagement with the drum inner surface to define a retention region of the volume corresponding generally to a segment of the drum outer surface between the granular-material-receiving position and the granular-material-pattern-laydown position;

connecting the retention region to a source of vacuum;

delivering granular material supplied to the hopper onto the drum outer surface at the granular-material-receiving position;

allowing vacuum from the retention region within the volume of the drum to act, through the plurality of apertures arranged in an element of the predetermined pattern to be formed upon the substrate, on granular material upon the drum outer surface in the vicinity of the plurality of apertures, thereby to retain granular material upon the drum outer surface;

rotating the drum outer surface to the granular-material-separation position and allowing excess granular material, not subject to action by the vacuum from within the retention region, to separate from the drum outer surface;

retrieving separated granular material on pre-laydown retriever means disposed generally between the excess granular-material-separation position of the drum outer surface and the substrate;

rotating the drum outer surface to the granular-material-pattern-laydown position at the termination of the retention region under vacuum, and positioning the granular material upon the substrate in the element of the desired predetermined pattern by allowing the granular material to disengage from the drum outer surface by removal of the vacuum;

continuing rotation of the drum outer surface to a cleaning station and engaging the drum outer surface with a cleaning member to dislodge remaining granular material from the drum outer surface;

retrieving granular material separated by cleaning on post-laydown retriever means disposed generally between the substrate and the cleaning position of the drum outer surface; and continuing rotation of the drum outer surface through a series of cycles to laydown a continuous pattern of granular material upon the substrate; and advancing the substrate through a series of stations to lay additional elements of the predetermined pattern of granular material upon the substrate.

2. The method of claim 1 comprising the further step of treating the substrate to secure the position of the granular material laid upon the substrate.

3. The method of claim 1 for forming floor covering comprising the further steps of disposing a pattern of granular material of suitable plastic upon the substrate and securing the granular material by curing.

4. The method of claim 3 comprising the further step of disposing a pattern of contrasting granular material upon the substrate.

5. The method of claim 4 wherein the contrasting material comprises a metallic flake.

6. The method of claim 1 for forming wall covering comprising the further steps of disposing a pattern of granular material of suitable plastic upon the substrate and securing the granular material by curing.

7. The method of claim 1 for forming food products comprising the further steps of disposing a pattern of granular decorative material of suitable edible material upon a food substrate.

8. The method of claim 1 comprising the further step of severing the substrate into a plurality of discrete elements.

9. An apparatus for laying down a continuous, predetermined pattern of granular material upon a moving substrate, said apparatus comprising:

a main conveyor mounted for continuous movement of a substrate therealong; and at least a first station disposed along said conveyor, and a second station disposed along said conveyor at a position spaced from said first station;

each said station comprising:

a drum having a generally cylindrical drum wall mounted for rotation above said substrate on said conveyor, said drum wall defining a drum outer surface and a drum inner surface;

a motor for rotating said drum outer surface through a sequence of positions comprising: a granular-material-receiving position, an excess granular-material-separation position, an granular-material-pattern-laydown position, and a cleaning position;

a volume defined by said drum wall and a baffle contained therewithin with free ends disposed in sliding engagement with said drum inner surface in a manner to define a retention region of said volume corresponding generally to a segment of said drum outer surface between said granular-material-receiving position and said granular-material-pattern-laydown position, said retention region disposed in communication with a source of vacuum;

a plurality of apertures defined by said drum wall and in communication between said drum inner surface and said drum outer surface, said plurality of apertures arranged in an element of the predetermined pattern to be formed upon the substrate;

a hopper positioned to receive a supply of granular material and to deliver the granular material onto the drum outer surface at said granular-material-receiving position;

pre-laydown retriever means, disposed generally between said excess-granular-material-separation position of said drum outer surface and said substrate, for receiving excess granular material from said drum outer surface;

a cleaning member disposed at said cleaning position for removing granular material from said drum surface; and post-laydown retriever means, disposed generally between said substrate and said cleaning position of said drum outer surface, for receiving granular material from said drum outer surface.

10. The apparatus of claim 9 wherein said hopper comprises a dam disposed in resilient engagement upon said drum outer surface.

11. The apparatus of claim 9 wherein said pre-laydown retriever means is disposed generally below said excess granular-material-separation position of said drum outer surface and above said substrate for receiving excess granular material from said drum outer surface.

12. The apparatus of claim 9 or 11 wherein said pre-laydown retriever means comprises a conveyor disposed to move generally transversely to the direction of said main conveyor, for retrieving excess granular material from said drum outer surface.

13. The apparatus of claim 9 wherein said post-laydown retriever means disposed generally below said cleaning position of said drum outer surface and above said substrate for receiving granular material from said drum outer surface.

14. The apparatus of claim 9 or 13 wherein said post-laydown retriever means comprises a conveyor disposed to move generally transversely to the direction of said main conveyor, for retrieving granular material remaining upon said first drum surface after laydown.

15. The apparatus of claim 9 wherein said cleaning element comprises a brush mounted for engagement with said drum outer surface.

16. The apparatus of claim 15 wherein said brush is mounted for reverse rotation on engagement with said drum outer surface.

* * * * *

US005419246B1

REEXAMINATION CERTIFICATE (3541st)

United States Patent [19] [11] B1 5,419,246

Bibby [45] Certificate Issued Jun. 9, 1998

[54] METHOD AND APPARATUS FOR LAYING A GRANULAR PATTERN

[76] Inventor: Kenneth Bibby, 9 Horseshoe Dr., Plainville, Mass. 02762-1610

Reexamination Request:
No. 90/004,401, Oct. 1, 1996

Reexamination Certificate for:

| | |
|---|---|
| Patent No.: | **5,419,246** |
| Issued: | **May 30, 1995** |
| Appl. No.: | **284,888** |
| Filed: | **Aug. 2, 1994** |

[51] Int. Cl.[6] ..... B41M 1/10
[52] U.S. Cl. ..... 101/170; 101/122; 101/150
[58] Field of Search ..... 101/122, 124, 101/142, 150, 153, 170, 489, 491, 492; 118/46, 50, 406, 621, 624, 301; 427/197; 355/301, 302

[56] References Cited

U.S. PATENT DOCUMENTS

| | | | |
|---|---|---|---|
| 1,448,203 | 3/1923 | Cumfer et al. . | |
| 1,908,445 | 5/1933 | Reimers . | |
| 2,559,543 | 7/1951 | Muench | 91/43 |
| 2,728,685 | 12/1955 | Muench | 117/25 |
| 2,774,102 | 12/1956 | Campbell | 18/1 |
| 2,937,614 | 5/1960 | Muench | 118/201 |
| 4,651,758 | 3/1987 | Kahran | 131/109.2 |
| 4,794,020 | 12/1988 | Lussi et al. | 427/195 |
| 4,916,007 | 4/1990 | Manning et al. | 428/203 |
| 5,246,765 | 9/1993 | Lussi et al. | 428/203 |

FOREIGN PATENT DOCUMENTS

| | | |
|---|---|---|
| 1222744 | 2/1971 | United Kingdom . |
| 8403848 | 10/1984 | WIPO . |

*Primary Examiner*—Ren Yan

[57] ABSTRACT

A method for laying down a continuous, predetermined pattern of granular material upon a moving substrate includes moving the substrate past at least two stations, each station including a rotating drum with a drum wall defining a limited retention region under vacuum, and a plurality of through-apertures arranged in an element of the desired pattern. Granular material applied to the surface of the drum is held by vacuum in the desired pattern. After removal of excess granular material, the vacuum is discontinued causing the granular material to disengage from the drum surface and pass, by force of gravity, onto the surface of the substrate in the form of the predetermined element of the desired predetermined pattern. An apparatus for laying down a continuous, predetermined pattern of granular material upon a moving substrate is also described.

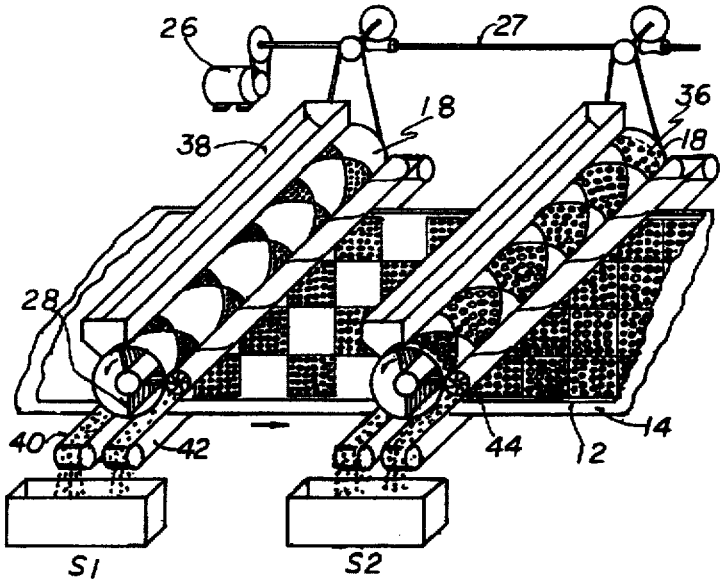

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–16 is confirmed.

* * * * *